United States Patent [19]

Derrick, Jr.

[11] 4,033,865

[45] July 5, 1977

[54] NON-CLOGGING SCREEN APPARATUS

[75] Inventor: H. William Derrick, Jr., Williamsville, N.Y.

[73] Assignee: Derrick Manufacturing Corporation, Buffalo, N.Y.

[22] Filed: Feb. 23, 1976

[21] Appl. No.: 660,490

Related U.S. Application Data

[63] Continuation of Ser. No. 531,175, Dec. 9, 1974, abandoned.

[52] U.S. Cl. ..... 209/275; 209/319; 209/402

[51] Int. Cl.[2] ..... B07B 1/28

[58] Field of Search ..... 209/315, 319, 346, 379, 209/384, 385, 391, 400, 402, 275

[56] References Cited

UNITED STATES PATENTS

| | | | |
|---|---|---|---|
| 516,673 | 3/1894 | Wilson | 209/402 |
| 1,132,667 | 3/1915 | Milliot | 209/402 X |
| 1,713,143 | 5/1929 | Overstrom | 209/319 X |
| 2,813,629 | 11/1957 | Brugmann | 209/403 |

*Primary Examiner*—Frank W. Lutter
*Assistant Examiner*—Ralph J. Hill
*Attorney, Agent, or Firm*—Christel & Bean

[57] ABSTRACT

A vibratory screening apparatus has a pair of screen cloths in close face to face abutment with the wires of the lower screen cloth generally intersecting the openings of the upper screen cloth to prevent "blinding" of the upper screen cloth by reason of the tendency of the wires of the lower screen cloth to prevent engagement of particles in the upper screen cloth of a size which would tend to clog the openings of the upper screen cloth. The mesh size of the lower screen cloth may be equal to the mesh size of the upper screen cloth or slightly larger than the upper screen cloth openings up to about 50 per cent larger. The superposed screen cloths may rest upon a much coarser mesh screen which serves merely as a structural support for the screen cloths and does not perform a screening function.

4 Claims, 7 Drawing Figures

NON-CLOGGING SCREEN APPARATUS

This is a continuation of application Ser. No. 531,175 filed Dec. 9, 1974 abandoned

BACKGROUND OF THE INVENTION

This invention relates to industrial screening equipment and more particularly to novel non-clogging screen cloth assemblies.

A very pressing problem exists in the screening art, particularly when screening finely divided material, due to the tendency of the material being screened to clog the openings in the screen cloth. This condition is sometimes referred to in the art as "blinding" of the screen surface. This blinding of the screen cloth greatly impairs the effectiveness of the screening capacity of the apparatus and may even reduce such capacity substantially to zero. Various methods have been employed to remove particles which have become wedged in the openings of the screen cloth as by shaking or the like, but none of these expedients has proved effective with particles of certain shapes.

It is conventional in the art to provide a backing or supporting screen beneath the primary screen cloth but such backing screens have openings a number of times greater than the openings in the screen cloth and are provided for structural support of the screen cloth and do not of themselves perform any screening function.

SUMMARY OF THE INVENTION

The present invention provides a novel screen cloth structure which solves the clogging or blinding problem in a new manner by preventing the wedging of particles in the screen openings rather than by attempting to dislodge particles after they have become wedged in the screen openings. This is accomplished by using a sandwich comprising a pair of screen cloths in immediate vertical juxtaposition. This is not to be confused with the backing screen referred to in the preceding paragraph and in fact a third very much coarser backing screen will preferably be used beneath the pair of screen cloths referred to here.

The mesh size of the screen cloths per se may be approximately the same although, for reasons which will appear later herein, it will generally be preferable to use a screen cloth of slightly larger mesh size beneath the top screen cloth.

In pursuing the principles of the present invention the openings in the screen cloths will be at least twice the width of the wire diameters and preferably at least two and a half times the wire diameter or more. Accordingly, when a particle of a size which might wedge into the opening of the top screen cloth tends to enter an opening therein it comes into contact with a wire of the lower screen cloth and is thus prevented from getting into a wedging position.

DESCRIPTION OF THE ILLUSTRATED EMBODIMENT

The general framing and support structure of the screen illustrated herein by way of example is conventional and comprises a rectangular frame 10 having a rigid screen support structure comprising a series of parallel stringer members 11 which extend longitudinally with respect to the direction of movement of material along the screen. So-called bulkhead members 12 extend parallel to each other between stringers 11 and are welded at their ends to the stringers 11. The bulkheads and stringers are arranged to present an upwardly arched surface in a transverse direction so that the screen elements are stretched over the top surface of the arch thus formed, as fragmentarily indicated in FIG. 3. It is to be understood that all of the foregoing is conventional in screening apparatus of the type here under consideration.

Figure 1:
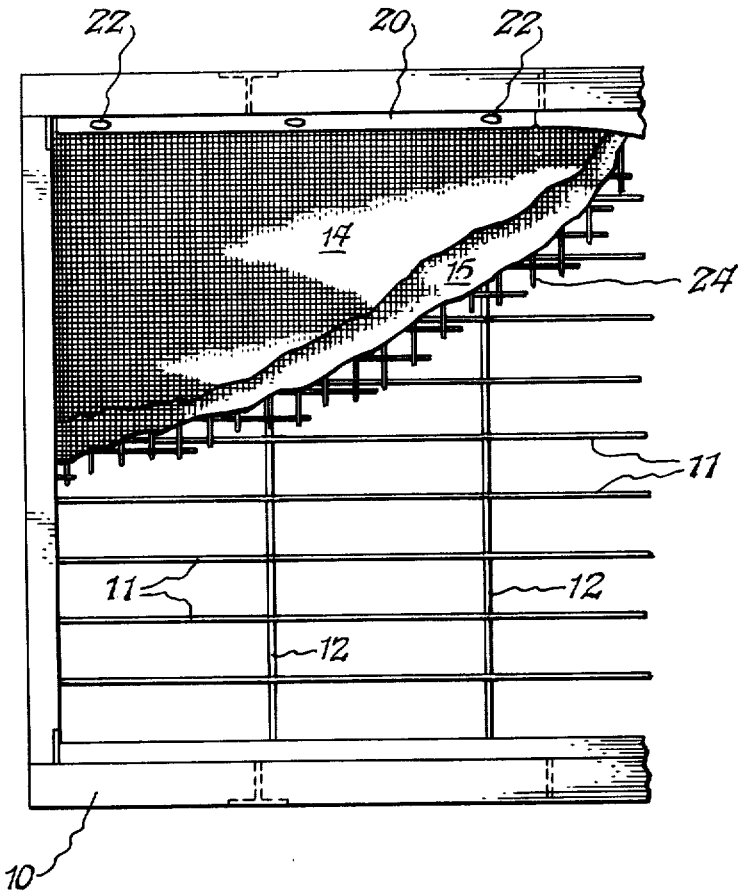
FIG. 1 is a fragementary top plan view of the left-hand portion of the screen frame constructed according to one form of the present invention.
Figure 2:
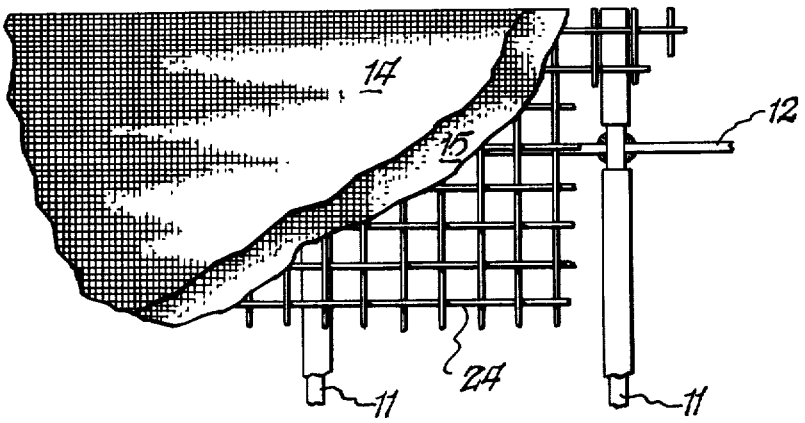
FIG. 2 is a fragmentary view taken similarly to FIG. 1 but on an enlarged scale and rotated through 90° relative to FIG. 1.
Figure 3:
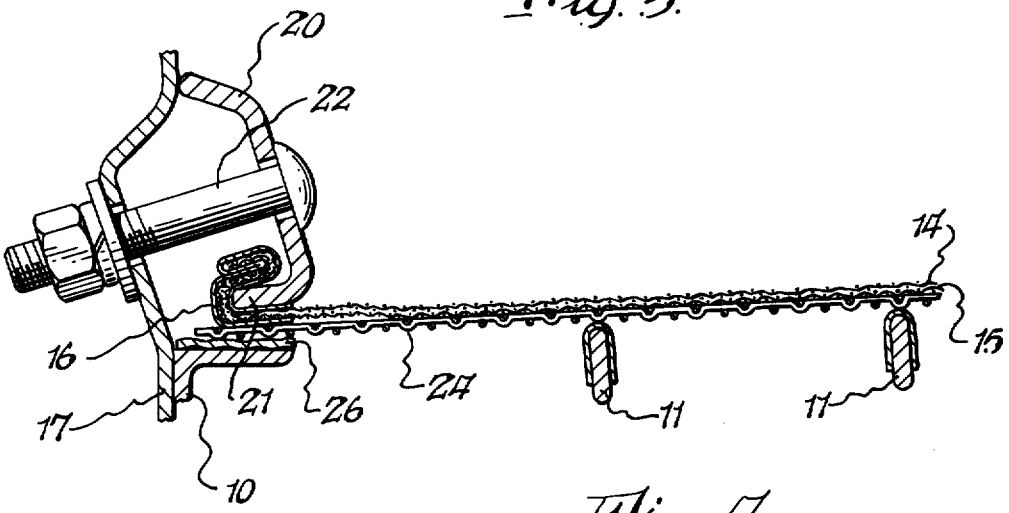
FIG. 3 is a transverse cross-sectional view through the left-hand side of the screen structure of FIGS. 1 and 2 on a generally vertical plane.

The top and bottom screen cloths which are sandwiched together in the present invention as generally indicated in the above Summary of the Invention are indicated at 14 and 15 in FIG. 3 and are jointly wrapped into a return-bent channel member 16 at their side edges. Flanges 17 are fixed to the side edges of frame 10 and a rail member 20 has a flange portion 21 which engages the return-bent member 16, as clearly shown in FIG. 3, and draws the same generally outwardly and downwardly by virtue of a bolt and nut connection 22 between rail member 20 and flange 17. A much coarser backing screen 24 underlies the two screen cloths 14 and 15 and the return-bent member 16 and rests upon the top surface of frame 10 and upon the stringers and bulkheads of the screen frame. In the present instance a cushioning strip 26 is interposed between frame 10 and backing screen 24.

As indicated earlier herein, the backing screen is a conventional expedient for supporting relatively fine screen cloths and has openings a number of times greater than the screen element openings and performs no screening function but serves entirely as a support for the screen cloths.

Figure 4:
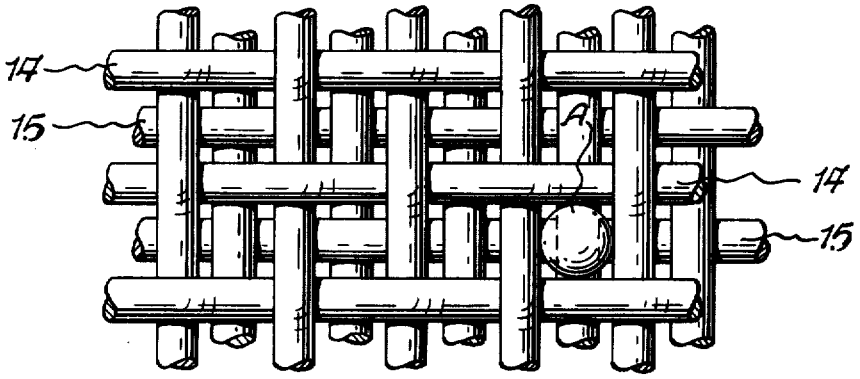
FIG. 4 is a much enlarged top plan view of one form of the screen arrangement of the present invention
Figure 5:
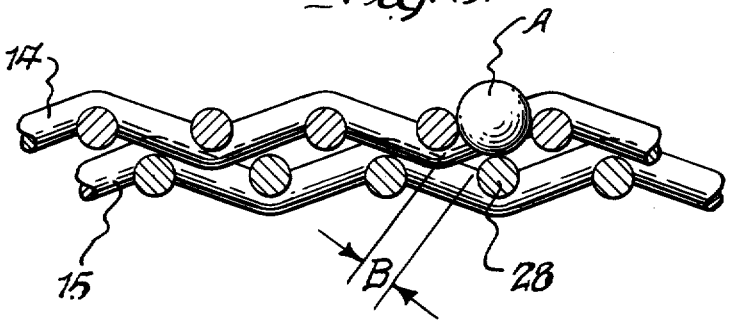
FIG. 5 is a transverse cross-sectional view through the screen structure of FIG. 4.

In the instance illustrated in FIGS. 4 and 5 the upper and lower screen cloths 14 and 15 are of the same mesh size and in such illustrated instance the wires of the lower screen cloth are arranged to be staggered with respect to the wires of the upper screen cloth so that each lower screen cloth wire lies approximately halfway between two superposed wires of the upper screen cloth. In alternative arrangements the wires of the lower screen cloth may be offset somewhat from this centered arrangement although such lower wires should be sufficiently offset from the upper wires to engage and dislodge particles which might tend to blind the upper screen openings or, in fact, to prevent the engagement of such particles in the upper screen openings.

Figure 6:
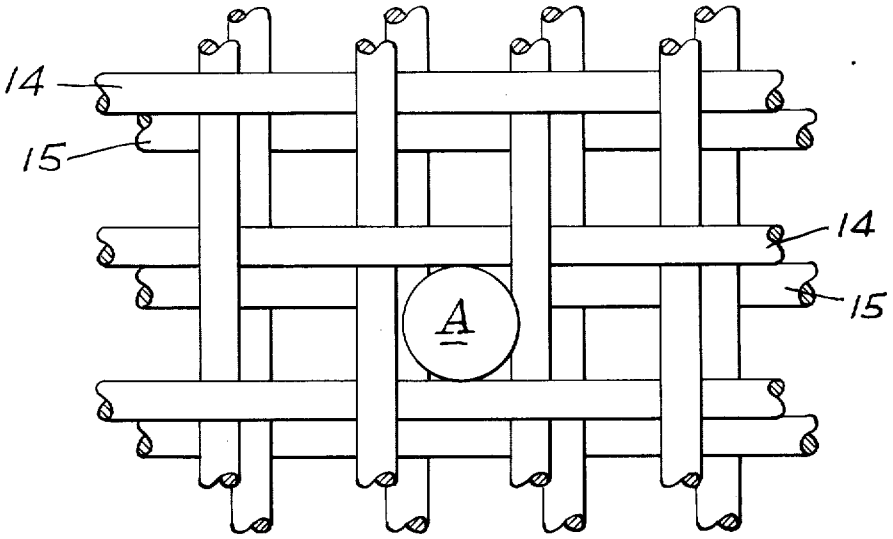
FIG. 6 is a view similar to FIG. 5 but showing the screen members in different relative positions.
Figure 7:
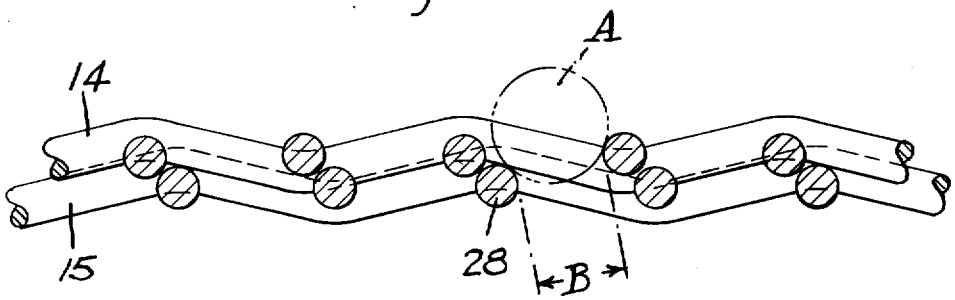
FIG. 7 is a view similar to FIG. 5 but showing the embodiment of FIG. 6.

By way of example, FIGS. 6 and 7 show an instance wherein the lower screen cloth is substantially offset from the centered arrangement illustrated in FIGS. 4 and 5. Since the screen cloths of FIGS. 6 and 7 are otherwise identical with those of FIGS. 4 and 5 like numerals have been applied to the several parts in FIGS. 6 and 7.

In many, if not most, instances the lower screen cloth may be of a somewhat larger mesh than the upper screen cloth but not of such degree as to leave a major portion of the openings of the upper screen cloth without underlying wires of the lower screen cloth.

This relationship between mesh size and registry of the wires of the two screen cloths is subject to considerable variation and is in general empirically determined by the type of material being screened and the general shapes and contours of the particles of such material.

While the relationship between the mesh size of the two screen cloths varies in accordance with various operating conditions and the type and size of material being screened, the mesh size of the lower screen cloth will in general vary between a minimum mesh size which is equal to that of the upper screen cloth and a maximum mesh size which is about 50% greater than the mesh size of the upper screen cloth. In all cases the openings in the screen cloths will be of a width at least twice the diameter of the wires of the screen cloth as to both the upper and lower screen cloths.

In FIG. 5 it will be noted that the actual effective mesh size would be as indicated by the dimension B indicating the space between a wire of lower screen 15 and the adjacent corresponding wire of upper screen 14. This dimension will be greater and more nearly approach the particle size opening of the upper screen cloth when the wires of the lower screen cloth are offset with respect to the wires of the upper screen cloth but not centered therebeneath as in FIG. 5. Where a larger mesh screen is employed in the lower screen cloth 15 dimension B will be variable across the surfaces of the two screen cloths.

Merely by way of example, it will be noted that wire 28 of lower screen cloth 15 prevents lodgement of a particle A in the opening of upper screen cloth 14. With particle A resting on wire 28 of screen 15 as in FIG. 5, there will be a slight lateral clearance between particle A and the two adjacent wires of screen 14 so that there is no tendency of particle A to become lodged between such two wires. There is no tendency of particles to lodge in the space indicated by the dimension B due to the slight relative movement between the screens which is a natural result of the rapid vertical vibration to which the screen cloths are subject during screening operations, such vertical vibrations tending to cause the upper screen cloth to move upwardly slightly away from the lower screen cloth and back toward the same during vibrational movements. Also, because of the arched condition of the screen cloths, there is a very slight relative movement of the two screen cloths in their plane of extent as the screen is vibrated.

Preferred embodiments of the present invention have been described herein and shown in the accompanying drawings to illustrate the underlying principles of the invention but it is to be understood that numerous modifications may be made without departing from the broad spirit and scope of the invention.

I claim:

1. In a vibratory screening apparatus for finely divided material, a pair of screen cloths in close face to face abutment for receiving material to be screened thereon, the upper screen cloth being of approximately 20 mesh or finer and the openings in the screen cloths being at least twice as wide as the wire diameters thereof, a frame for supporting said screen cloths, the lower screen cloth having openings therein at least as large as the openings in the upper screen cloth but not in excess of 50 percent larger than the openings in the upper screen cloth and with the majority of the openings in the upper screen cloth intersected by the wires of the lower abutting screen cloth, said frame including a transverse series of spaced parallel longitudinally extending stringers whose upper edges define a transverse arch for supporting said screen cloths in upwardly arched formation, whereby the longitudinal wires of one screen are held securely against the transverse wires of the other screen and vice versa to lock the wires of one screen into the wires of the other in such manner that the plane defining the upper surfaces of the lower screen is above the plane defining the lower surfaces of the upper screen whereby the strands of said lower screen effectively prevents a generally spheroidal particle from becoming lodged in an opening of said upper screen, said convex surfaces further serving to effectively prevent relative vertical movement of said screen cloths during vibration thereof.

2. Screening apparatus according to claim 1 wherein a backing screen of a mesh at least several times coarser than the mesh of the screen cloths underlies the lower screen cloth to support the screen cloths.

3. Screening apparatus according to claim 1 wherein the upper and lower screen cloths are of the same mesh size and wherein the wires of the lower screen cloth are offset in at least one horizontal direction with respect to the wires of the upper screen cloth.

4. Screening apparatus according to claim 1 wherein the lower screen cloth is of a larger mesh size than the upper screen cloth but wherein the openings in the lower screen cloth are less than about 50 percent larger than the openings in the upper screen cloth.

* * * * *